US008037999B1

(12) United States Patent
Kumar

(10) Patent No.: US 8,037,999 B1
(45) Date of Patent: Oct. 18, 2011

(54) SOAP DISH SYSTEM

(76) Inventor: Sivathanu B. Kumar, Tampa, FL (US)

( * ) Notice: Subject to any disclaimer, the term of this patent is extended or adjusted under 35 U.S.C. 154(b) by 389 days.

(21) Appl. No.: 12/283,736

(22) Filed: Sep. 15, 2008

Related U.S. Application Data

(63) Continuation-in-part of application No. 10/947,193, filed on Sep. 22, 2004, now Pat. No. 7,424,949.

(51) Int. Cl.
*A47K 5/08* (2006.01)

(52) U.S. Cl. ..... 206/77.1; 220/572

(58) Field of Classification Search ..... 206/77.1, 206/559, 561, 565; 220/495.02, 495.03, 220/23.8, 23.2; 108/24
See application file for complete search history.

(56) References Cited

U.S. PATENT DOCUMENTS 2,930,160 A * 3/1960 Pohl ..... 206/77.1
3,019,549 A * 2/1962 Evans ..... 206/77.1
4,331,232 A * 5/1982 Larkin ..... 206/77.1
5,509,529 A 4/1996 Kelley
5,947,272 A 9/1999 Park
6,662,940 B1 12/2003 Kowal
7,424,949 B2 * 9/2008 Kumar ..... 206/77.1

* cited by examiner

*Primary Examiner* — A. Joseph Wujciak, III

(57) ABSTRACT

A soap dish has a plurality of apertures for the passage of water. An imperforate tray is fabricated of a moisture impervious material for the retaining of water in the tray. A primary region supports the tray. A secondary region is laterally spaced from the primary region. A coupling assembly includes an attachment mechanism. The attachment mechanism has an internal end and an external end. The internal end is operatively coupled with respect to the primary region. The external end is operatively coupled with respect to the soap dish. The coupling assembly is adapted to allow the movement of the soap dish with respect to the tray between an inoperative orientation and an operative orientation and through an intermediate orientation.

3 Claims, 13 Drawing Sheets

SOAP DISH SYSTEM

RELATED APPLICATION

The present U.S. Patent application is a continuation-in-part of U.S. application Ser. No. 10/947,193 filed Sep. 22, 2004 now U.S. Pat. No. 7,424,949, the subject matter of which is incorporated herein by reference.

BACKGROUND OF THE INVENTION

1. Field of the Invention

The present invention relates to a soap dish system and more particularly pertains to facilitating the support and movement of a bar of soap between an operative orientation and a stored orientation in a clean, safe, convenient and economical manner.

2. Description of the Prior Art

The use of soap holders of known designs and configurations is known in the prior art. More specifically, soap holders of known designs and configurations previously devised and utilized for the purpose of storing soap through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,509,529 issued Apr. 23, 1996 to Kelley relates to a Soap Bar Holder. U.S. Pat. No. 5,947,272 issued Sep. 7, 1999 to Park relates to a Soap Case. Lastly, U.S. Pat. No. 6,662,940 issued Dec. 16, 2003 to Kowal relates to a Draining Soap Dish for Multiple Bars of Soap.

While these devices fulfill their respective, particular objectives and requirements, the aforementioned patents do not describe a soap dish system that allows for facilitating the support and movement of a bar of soap between an operative orientation and a stored orientation in a clean, safe, convenient and economical manner.

In this respect, the soap dish system according to the present invention substantially departs from the conventional concepts and designs of the prior art, and in doing so provides an apparatus primarily developed for the purpose of facilitating the support and movement of a bar of soap between an operative orientation and a stored orientation in a clean, safe, convenient and economical manner.

Therefore, it can be appreciated that there exists a continuing need for a new and improved soap dish system which can be used for facilitating the support and movement of a bar of soap between an operative orientation and a stored orientation in a clean, safe, convenient and economical manner. In this regard, the present invention substantially fulfills this need.

SUMMARY OF THE INVENTION

In view of the foregoing disadvantages inherent in the known types of soap holders of known designs and configurations now present in the prior art, the present invention provides an improved soap dish system. As such, the general purpose of the present invention, which will be described subsequently in greater detail, is to provide a new and improved soap dish system and method which has all the advantages of the prior art and none of the disadvantages.

To attain this, the present invention essentially comprises a soap dish system. First provided is a soap dish. The dish has a base. The base is in a circular configuration. The base has upstanding sidewalls. In this manner a bar of soap is supported. The dish has an open top. In this manner movement of a bar of soap into and out of the soap dish is allowed. The base and walls of the soap dish are fabricated with a plurality of apertures. In this manner water may pass from the soap dish.

A tray is provided. The tray has a base. The base is in a circular configuration. The base has upstanding sidewalls. In this manner, when positioned above, moisture from a bar of soap is supported. The tray has an open top. In this manner movement of water into and out of the tray is allowed. The base and the walls of the tray are imperforate. The base and the walls of the tray are fabricated of a moisture impervious material. In this manner water is retained in the tray.

Provided next is a primary region. The primary region has a recipient surface. In this manner the tray is received and supported. When the soap dish is in the operative orientation, the tray is adapted to receive water from the soap dish there above. The tray is further adapted to allow the received water to be retrained until tipped. A secondary region is provided. The secondary region is laterally spaced from the primary region. The secondary region has a drain. When the soap dish is in an inoperative orientation, the tray is adapted to receive water from the soap dish there above. The tray is further adapted to allow the received water to be drained away.

Further provided is a coupling assembly. The coupling assembly includes an attachment mechanism. The attachment mechanism has an internal end and an external end. The internal end is operatively coupled with respect to the primary region. The external end is operatively coupled with respect to the soap dish. The coupling assembly is positioned adjacent to the tray. The soap dish and the tray are of a common diameter. The coupling assembly includes a hollow circular ring. The ring constitutes the attachment mechanism. A first vertical axis is provided. The tray has a recess. The internal end is pivotally attached to the tray through the first vertical axis. The first vertical axis is positioned in the recess. A second vertical axis is provided. The external end is pivotally attached to the soap dish through the second vertical axis. The second vertical axis is positioned in the recess in the soap dish. The first and second vertical axes are at diametrically opposite locations of the ring.

The coupling assembly is adapted to allow the movement of the soap dish with respect to the tray between an inoperative orientation and an operative orientation and through an intermediate orientation. The inoperative orientation is at a location with the soap dish above the tray. In this manner moisture from the soap in the tray will fall through the apertures of the soap dish into the tray. The inoperative orientation is at a location with the soap dish above the secondary area. In this manner moisture from the soap dish will fall through the apertures of the soap dish and be drained away.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is, therefore, an object of the present invention to provide a new and improved soap dish system which has all of the advantages of the prior art soap holders of known designs and configurations and none of the disadvantages.

It is another object of the present invention to provide a new and improved soap dish system which may be easily and efficiently manufactured and marketed.

It is a further object of the present invention to provide a new and improved soap dish system which is of durable and reliable constructions.

An even further object of the present invention is to provide a new and improved soap dish system which is susceptible of a low cost of manufacture with regard to both materials and labor, and which accordingly is then susceptible of low prices of sale to the consuming public, thereby making such soap dish system economically available to the buying public.

Even still another object of the present invention is to provide a soap dish system for facilitating the support and movement of a bar of soap between an operative orientation and a stored orientation in a clean, safe, convenient and economical manner.

Lastly, it is an object of the present invention to provide a new and improved soap dish system. A soap dish has a plurality of apertures for the passage of water. An imperforate tray is fabricated of a moisture impervious material for the retaining of water in the tray. A primary region supports the tray. A secondary region is laterally spaced from the primary region. A coupling assembly includes an attachment mechanism. The attachment mechanism has an internal end and an external end. The internal end is operatively coupled with respect to the primary region. The external end is operatively coupled with respect to the soap dish. The coupling assembly is adapted to allow the movement of the soap dish with respect to the tray between an inoperative orientation and an operative orientation and through an intermediate orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures of the present invention appended hereto and throughout the various alternate embodiments of the present invention.

DESCRIPTION OF THE PREFERRED EMBODIMENT

Figure 1:
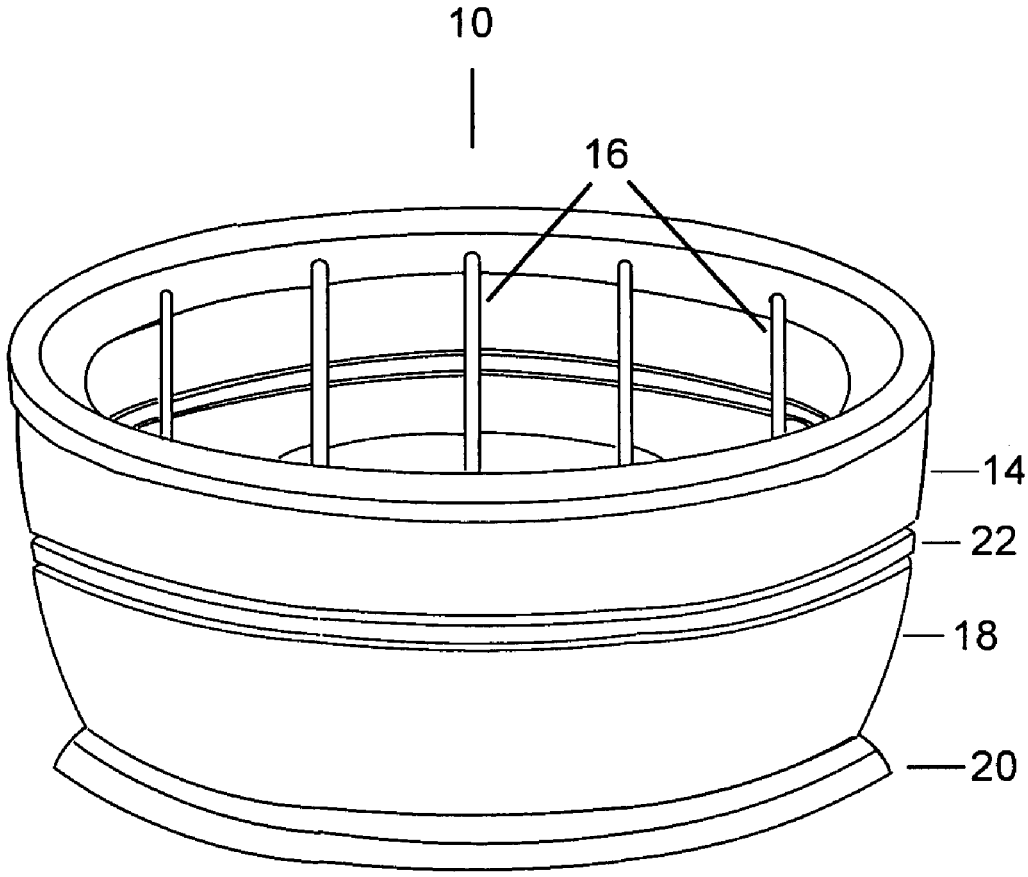
FIG. 1 is a perspective illustration of a soap dish handling system constructed in accordance with the principles of the present invention.
Figure 1A:
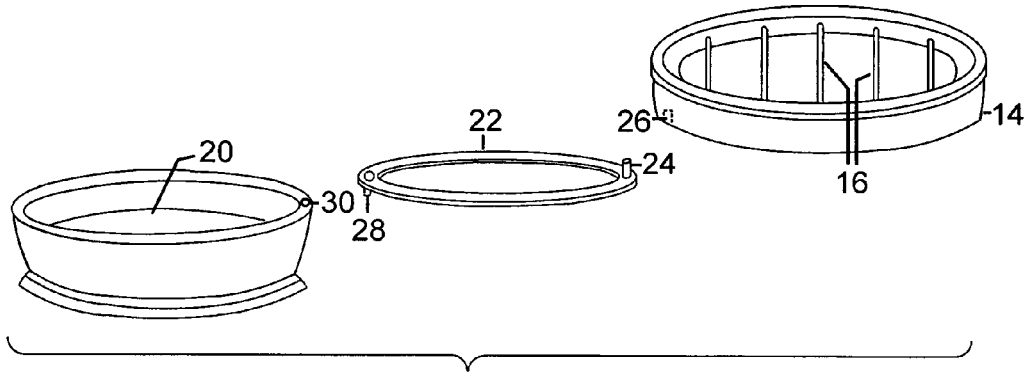
FIGS. 1A and 1B are a laterally exploded perspective illustration and an extended perspective illustration of the system shown in FIG. 1.
Figure 1B:
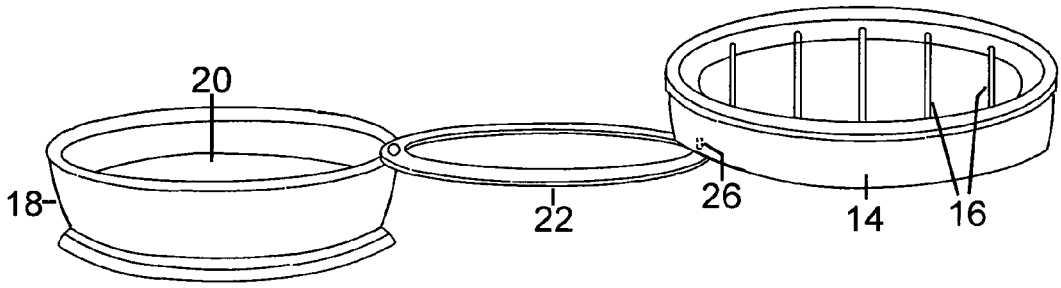
Figure 2:
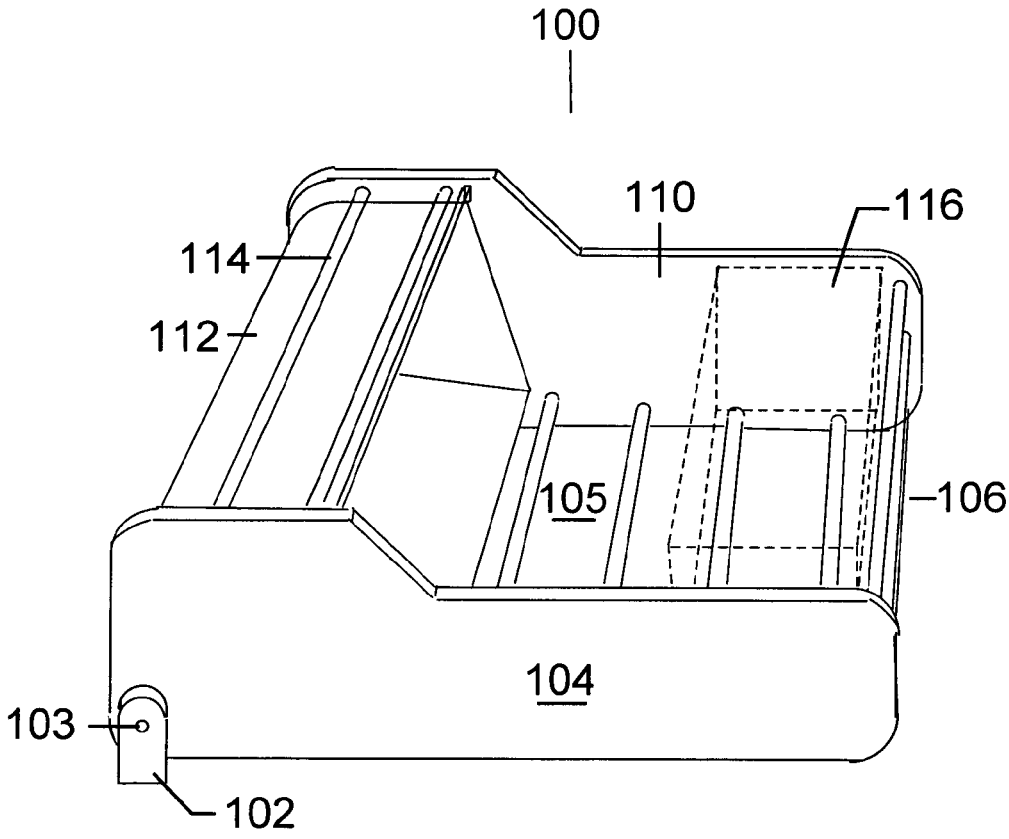
FIG. 2 is a perspective illustration of a soap dish handling system constructed in accordance with an alternate embodiment of the present invention.
Figure 2A:
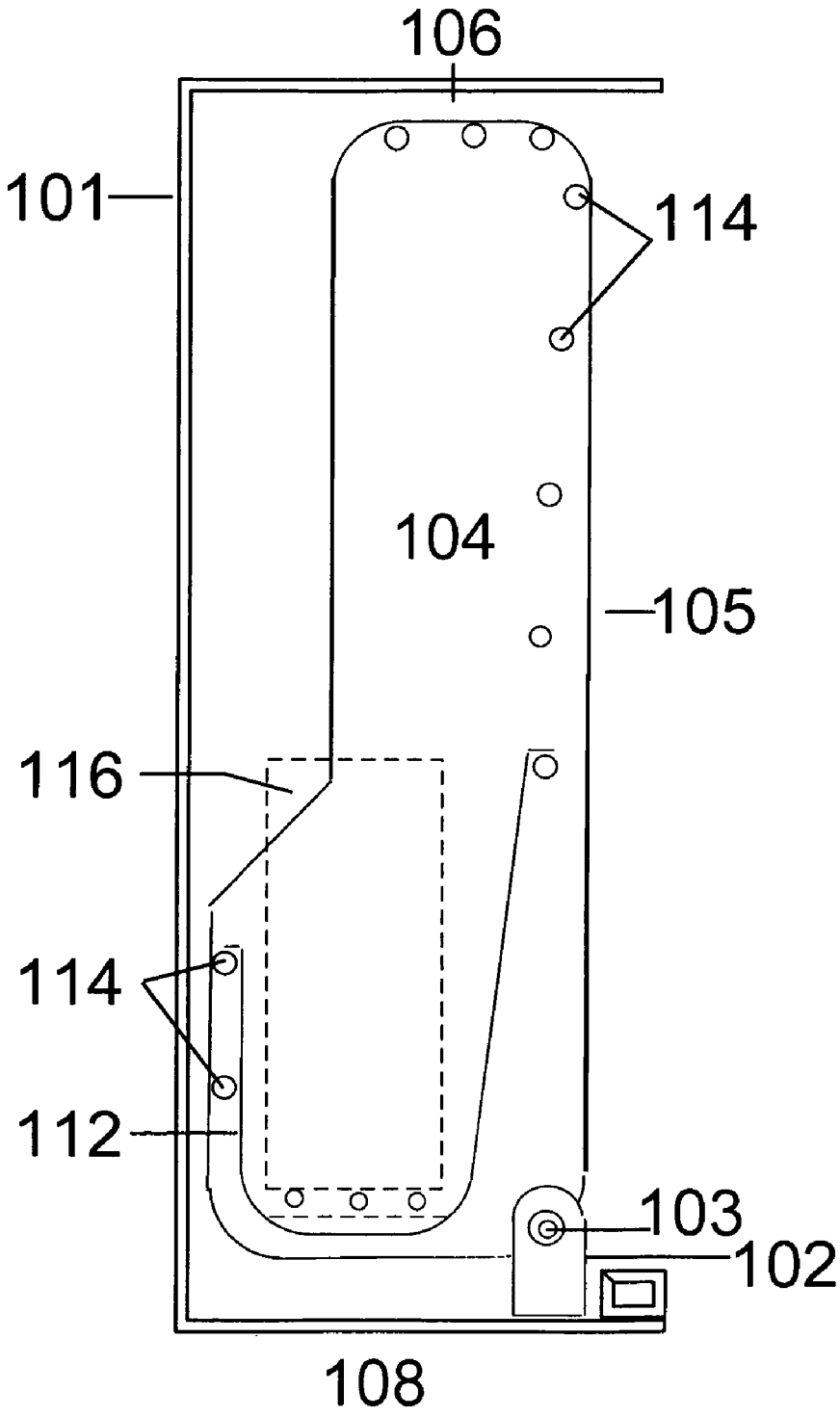
FIGS. 2A, 2B and 2C are a side elevational view in a retracted orientation, a side elevational view in an intermediate orientation and a side elevational view in an extended orientation, all of the system shown in FIG. 1.
Figure 2B:
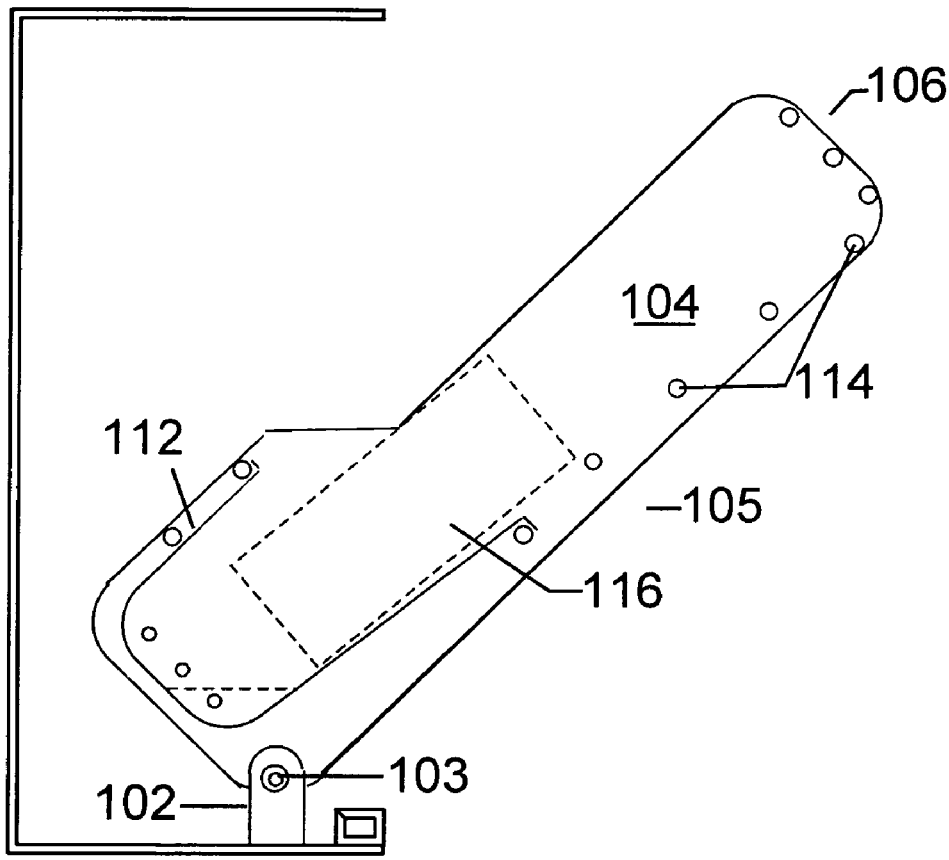
Figure 2C:
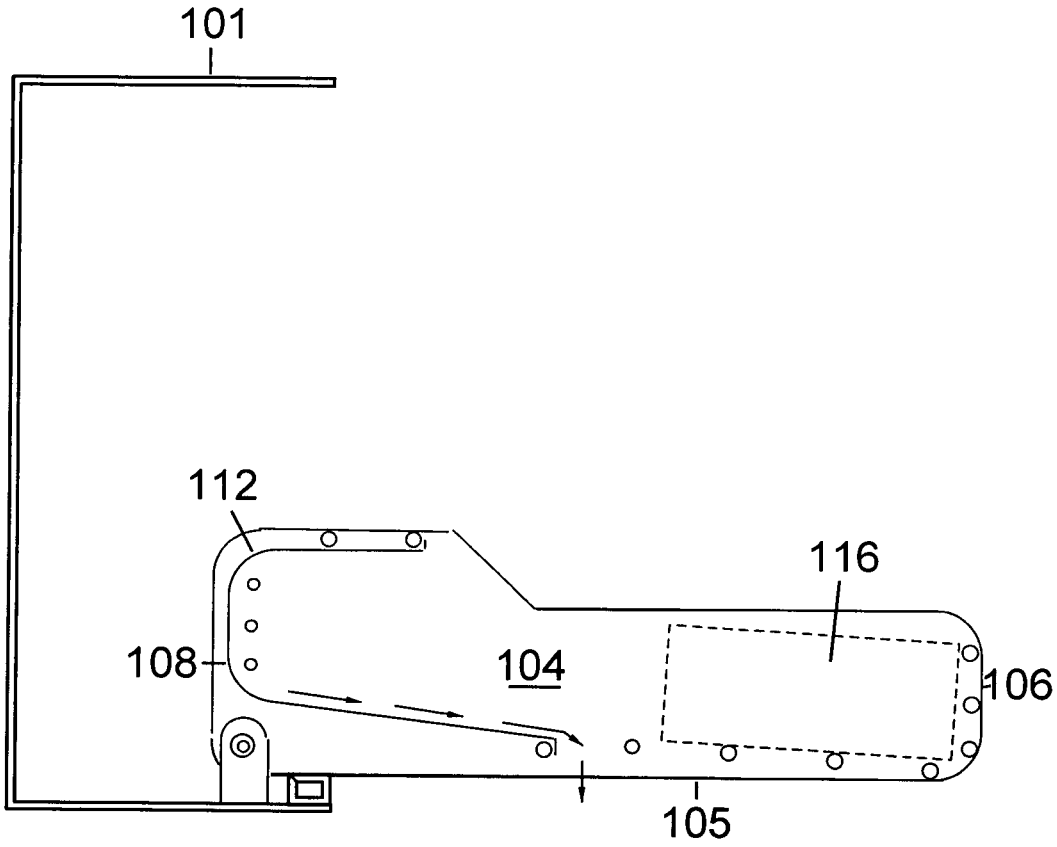

With reference now to the drawings, and in particular to FIG. 1 thereof, the preferred embodiment of the new and improved soap dish system embodying the principles and concepts of the present invention and generally designated by the reference numeral 10 will be described.

The present invention, the soap dish system 10 is comprised of a plurality of components. Such components in their broadest context include a soap dish, an imperforate tray, a primary region and a coupling assembly. Such components are individually configured and correlated with respect to each other so as to attain the desired objective.

First provided is a soap dish 14. The dish has rails 16 supported at their ends by a side wall. The side wall is in a circular configuration. The base has upstanding sidewalls. In this manner a bar of soap is supported. The dish has an open top. In this manner movement of a bar of soap into and out of the soap dish is allowed. The soap dish is fabricated with a plurality of apertures. In this manner water may pass from the soap dish.

A tray 18 is provided. The tray has a base 20. The base is in a circular configuration. The base has upstanding sidewalls. In this manner, when positioned above, moisture from a bar of soap is supported. The tray has an open top. In this manner movement of water into and out of the tray is allowed. The base and the walls of the tray are imperforate. The base and the walls of the tray are fabricated of a moisture impervious material. In this manner water is retained in the tray.

Provided next is a primary region. The primary region has a recipient surface. In this manner the tray is received and supported. When the soap dish is in the operative orientation, the tray is adapted to receive water from the soap dish there above. The tray is further adapted to allow the received water to be retrained until tipped. A secondary region is provided. The secondary region is laterally spaced from the primary region. The secondary region has a drain. When the soap dish is in an inoperative orientation, the tray is adapted to receive water from the soap dish there above. The tray is further adapted to allow the received water to be drained away.

Further provided is a coupling assembly. The coupling assembly includes an attachment mechanism. The attachment mechanism has an internal end and an external end. The internal end is operatively coupled with respect to the primary region. The external end is operatively coupled with respect to the soap dish. The coupling assembly is positioned adjacent to the tray. The soap dish and the tray are of a common diameter. The coupling assembly includes a hollow circular ring 22. The ring constitutes the attachment mechanism. A first vertical axis 28 is provided. The tray has a recess 30. The internal end is pivotally attached to the tray through the first vertical axis. The first vertical axis is positioned in the recess. A second vertical axis 24 is provided. The external end is pivotally attached to the soap dish through the second vertical axis 26. The second vertical axis is positioned in the recess in the soap dish. The first and second vertical axes are at diametrically opposite locations of the ring.

The coupling assembly is adapted to allow the movement of the soap dish with respect to the tray between an inoperative orientation and an operative orientation and through an intermediate orientation. The inoperative orientation is at a location with the soap dish above the tray. In this manner moisture from the soap in the tray will fall through the apertures of the soap dish into the tray. The inoperative orientation is at a location with the soap dish above the secondary area. In this manner moisture from the soap dish will fall through the apertures of the soap dish and be drained away.

An alternate embodiment 100 of the present invention is provided. Note FIG. 2 and FIGS. 2A through 2C. The soap dish and the tray are in a rectilinear configuration located in a recess 101. The coupling assembly includes a horizontally disposed pivot pin 103. The coupling assembly includes upstanding fingers 102. The fingers constitute the attachment mechanism. The fingers have lower internal ends. The lower internal ends are secured adjacent to the tray. The fingers have upper external ends. The upper external ends receive the pivot pin. The pivot pin is pivotally attached to the soap dish 105. In this manner pivotal movement of the soap dish is allowed. The soap dish has side walls 104 and 110. The soap dish has a top 106. The soap dish has a bottom 108. The soap dish has a lower edge 108. An imperforate sheet 112 is provided. The imperforate sheet is provided between the side walls adjacent to the bottom. Rods 114 are provided. The rods couple the side walls. The coupling assembly is adapted to allow the movement of the soap dish with respect to the tray between an inoperative orientation, an operative orientation and an intermediate orientation. In the inoperative orientation the soap dish is tipped rearwardly to the vertical. Note the water line beneath the soap. In this manner excess moisture is allowed to fall to the tray. In the operative orientation the soap dish is tipped forwardly greater than 90 degrees from the vertical. In this manner the bar of soap 116 is allowed to slide in to the external end. In this manner the moisture contained in the tray is allowed to fall to a drain. Note the arrows showing the water flow. In this intermediate orientation the soap dish extends upwardly. In this manner excess moisture from falling from the soap dish is precluded.

Another alternate embodiment 200 of the present invention is provided. Note FIGS. 3 and 3A through 3F. The coupling assembly includes a soap dish 204. The coupling assembly includes a tray 206 with soap supporting rails. The tray is formed as a recess in the sink supporting surface 201. A groove 216 in the sink supporting surface functions to drain away excess water and related fluids. The coupling assembly includes a lower post 208. The lower post couples the tray and the coupling assembly. The coupling assembly includes an upper post 210. The upper post couples the coupling assembly to the soap dish. The coupling assembly includes a rotatable coupler formed of a rotator 214, a recess 238 in the rotator and a pivot pin 236 extending upwardly into the recess. The rotatable coupling joins the soap dish to the primary region. In this manner the soap dish may rotate around a vertical axis. The coupling assembly also includes a linear slider 212. The linear slider is extendable to vary the distance between the internal and external ends.

Figure 3:
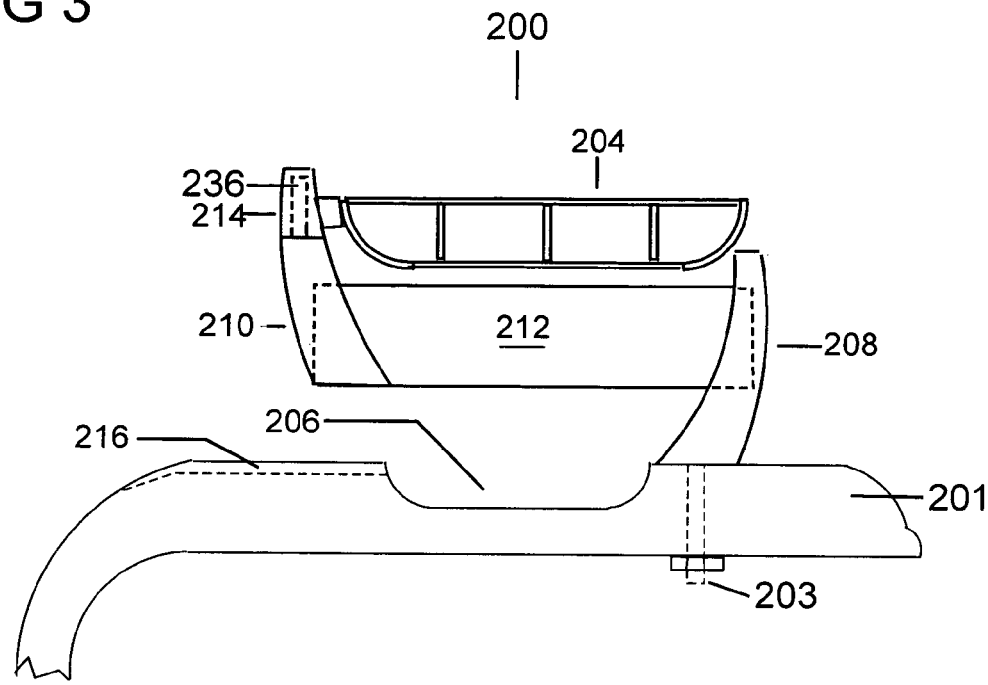
FIG. 3 is a side elevational view of a soap dish handling system constructed in accordance with another alternate embodiment of the present invention.
Figure 3G:
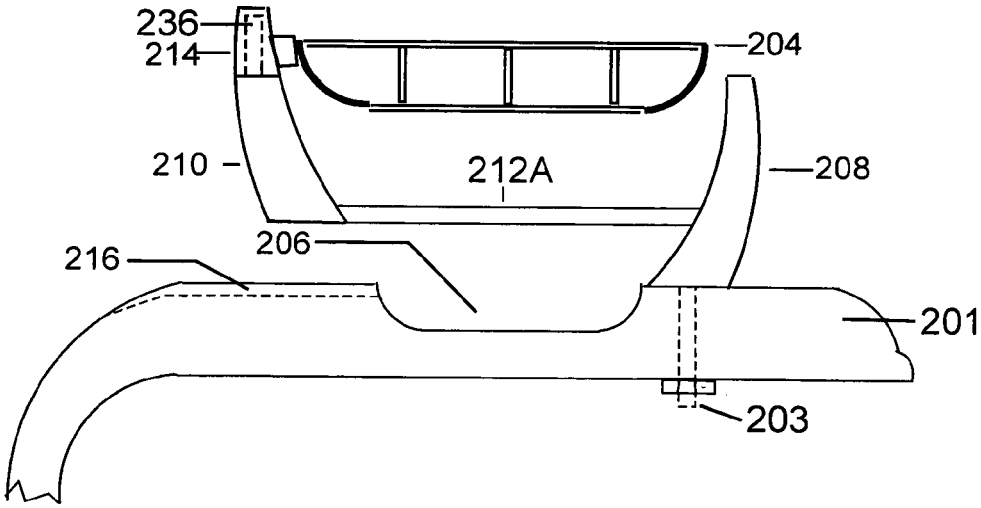
FIG. 3G illustrates yet another variation of the FIG. 3 embodiment.
Figure 3A:
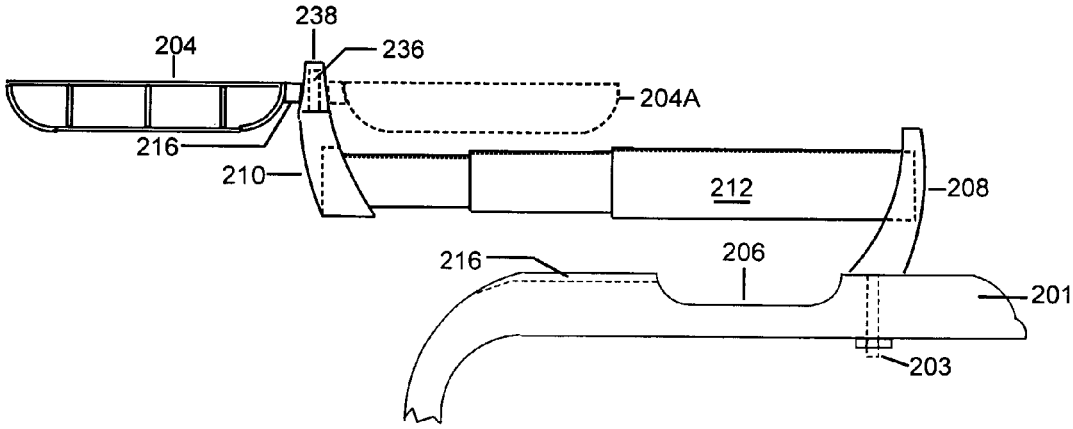
FIGS. 3A, 3B are a side elevational view in an extended orientation, a side elevational view in a retracted orientation and a side elevational view in an extended orientation, all of the system shown in FIG. 1.
Figure 3B:
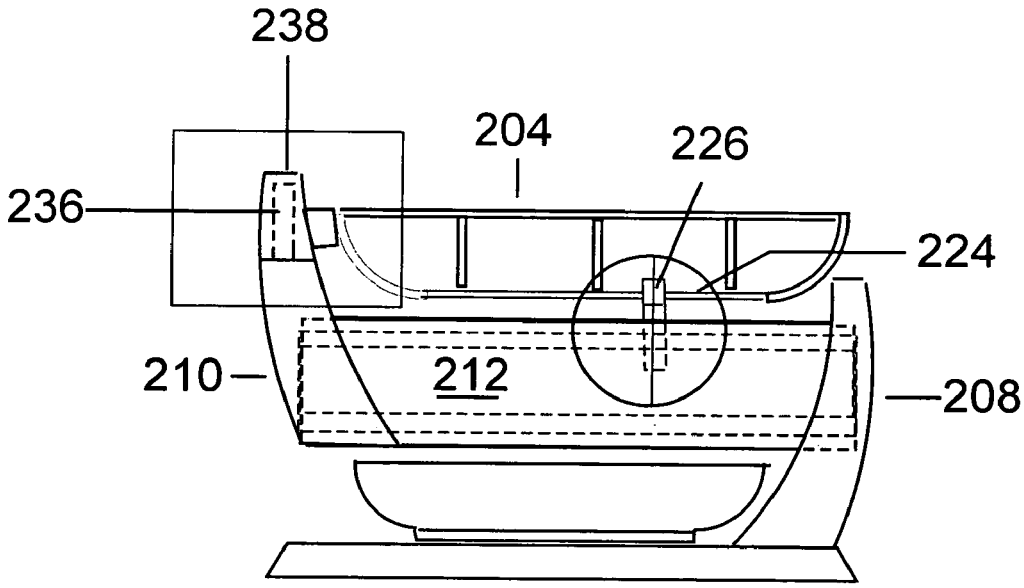
Figure 3C:
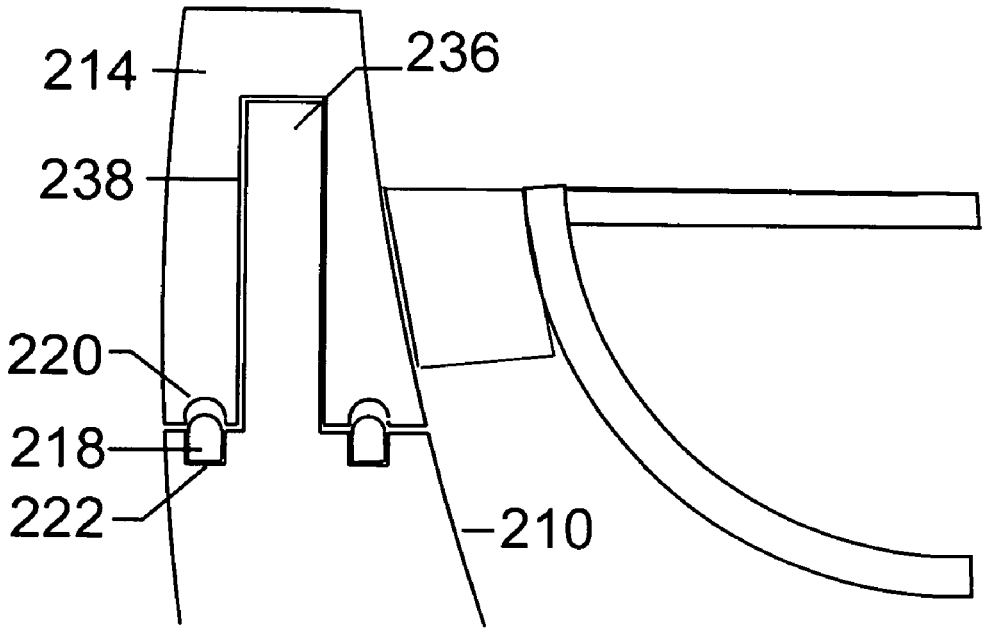
FIGS. 3C, 3D and 3E are enlarged showings taken at the rectangle and circle of FIG. 3B.

Reference is now made to FIG. 3C which illustrates a spring urged ball 218 and a plurality of recesses 220. The ball is in a recess 222 of the upper post 210. Recess 220 is in the rotator 214. The ball and recesses by being located in complementary portions of the attachment mechanisms will function for retaining the soap dish in an intended rotational position with respect to tray.

Figure 3D:
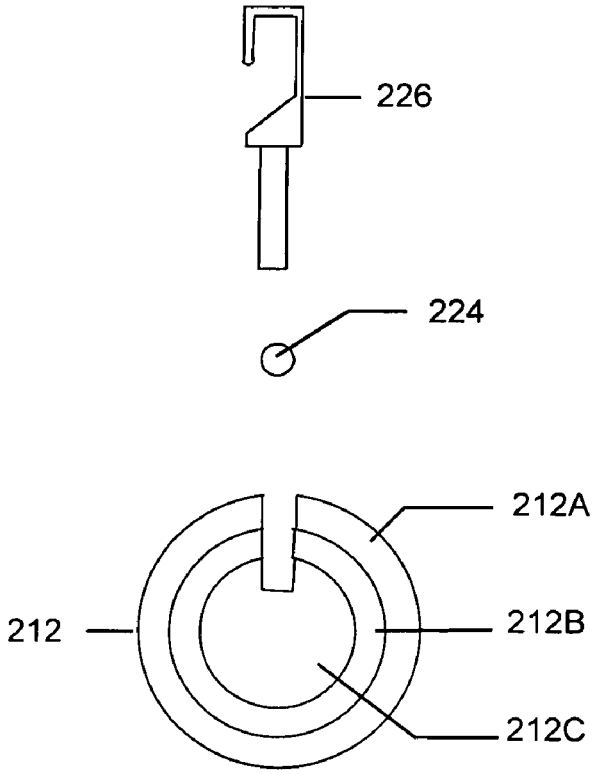
Figure 3E:
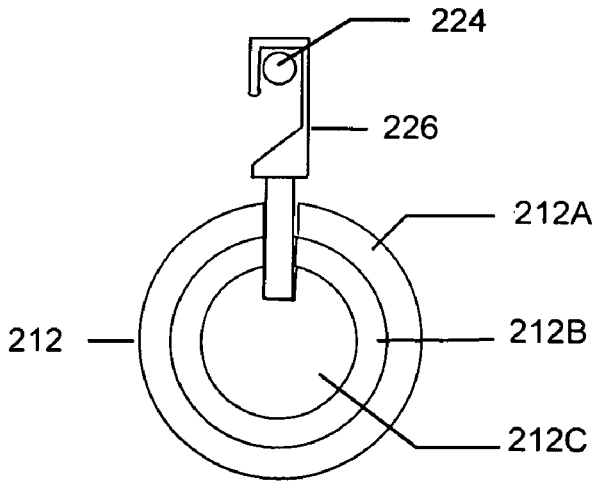

Another alternate embodiment of the present invention is illustrated in FIGS. 3D and 3E. Hooks 226 are provided. The hooks are positionable between an inoperative position and an operative position. The hooks, when in the inoperative position, are removed from the soap dish. In this manner free movement of the soap dish is allowed. The hook, when in the operative position, have a cylindrical lower end inserted into aligned apertures in the linear extender tubes 212A, 212B, 212C. Such apertures are aligned when tubes of the extender 212 are in the retracted inoperative orientation. In this manner, the hook 226 encompasses the rail 224 of the soap dish whereby all movement of the soap dish is precluded.

Figure 3F:
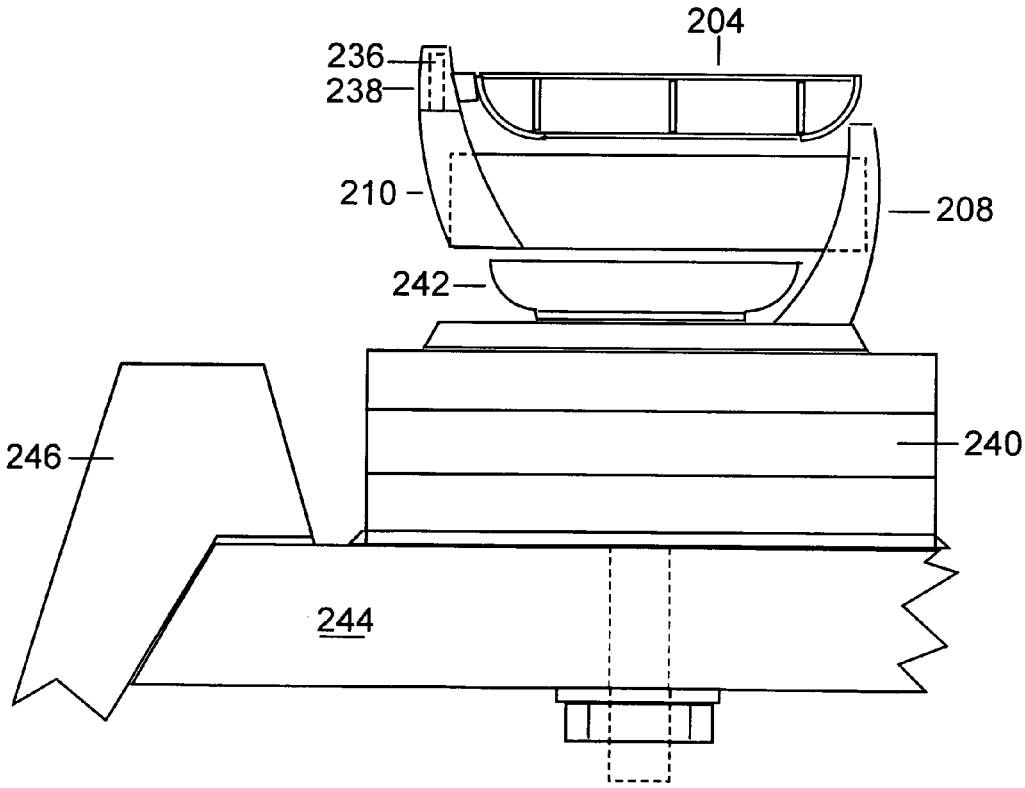
FIG. 3F illustrates another variation of the FIG. 3 embodiment.

Lastly, note is taken of FIGS. 3F and 3G embodiment. In the FIG. 3F embodiment, the tray 242 is supported on a stack of planar spacers 240. The spacers are supported on a sink surface 244 adjacent to a sink 246 laterally spaced from the tray. A bolt couples the spacers to the surface with the height of the spacers and tray being variable at the discretion of the user as a function of the number of spacers utilized. The FIG. 3G embodiment is essentially the same as the FIG. 3 embodiment except that the linear extender tubes 212 are replaced by a single non-extendable tube 212A. The ability to extend the tubes linearly is thus eliminated.

It is the scope of this invention that this device be combined with another device(s) or object(s) such as, but not limited to, a sink to form as one unit. The components of this device, in part or as a whole, are incorporated as a component, in part or as a whole, of another device(s) or object(s). The components of other device(s), in part or as a whole, are incorporated in part or as a whole component of this device(s) while maintaining the sprit of this invention.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A soap dish handling system comprising:

a soap dish with a plurality of apertures for the passage of water;

an imperforate tray fabricated of a moisture impervious material for the retaining of water in the tray;

a primary region supporting the tray and a secondary region supporting the dish laterally spaced from the primary region; and a coupling assembly including an attachment mechanism having an internal end and an external end, the internal end being operatively coupled with respect to the primary region, the external end operatively coupled with respect to the soap dish, the coupling assembly adapted to allow the movement of the soap dish with respect to the tray between an inoperative orientation and an operative orientation and through an intermediate orientation wherein the attachment mechanism includes a ring, the ring having the internal end which is pivotally attached to the tray through a first vertical axis and wherein the ring has the external end which is pivotally attached to the soap dish through a second vertical axis, the first and second vertical axes being at diametrically opposite locations of the ring and wherein the soap dish and the tray and the coupling assembly including the ring have a smooth and continuous exterior surface when in the inoperative orientation.

2. A soap dish handling system comprising:

a soap dish with a plurality of apertures for the passage of water;

an imperforate tray fabricated of a moisture impervious material for the retaining of water in the tray;

a primary region supporting the tray and a secondary region supporting the dish laterally spaced from the primary region; and a coupling assembly including an attachment mechanism having an internal end and an external end, the internal end being operatively coupled with respect to the primary region, the external end operatively coupled with respect to the soap dish, the coupling assembly adapted to allow the movement of the soap dish with respect to the tray between an inoperative orientation and an operative orientation and through an intermediate orientation wherein the attachment mechanism includes a ring, the ring having the internal end pivotally attached to the tray through a first vertical axis and with the external end pivotally attached to the soap dish through a second vertical axis, the first and second vertical axes being at diametrically opposite locations of the ring and wherein the coupling assembly including the ring when in the primary region, combine to form a unified continuous configuration and esthetic appearance.

3. A soap dish handling system for facilitating the support and movement of a bar of soap between an operative orientation and a stored orientation in a clean, safe, convenient and economical manner, the system comprising, in combination:

a soap dish having a base in a circular configuration with upstanding sidewalls for supporting a bar of soap, the dish having an open top to allow movement of a bar of soap into and out of the soap dish, the base and walls of the soap dish being fabricated with a plurality of apertures for the passage of water from the soap dish;

a tray constructed of a base in a circular configuration with upstanding sidewalls for supporting moisture from a bar of soap when positioned there above, the tray having an open top to allow movement of water into and out of the tray, the base and the walls of the tray being imperforate and fabricated of a moisture impervious material for the retaining water in the tray;

a primary region having a recipient surface for receiving and supporting the tray, the tray adapted to receive water from the soap dish there above when the soap dish is in the operative orientation and for allowing the received water to retrained until tipped, a secondary region supporting the dish laterally spaced from the primary region, the secondary region having a drain adapted to receive water from the soap dish there above when the soap dish is in the operative orientation and for allowing the received water to be drained away; and a coupling assembly including an attachment mechanism having an internal end and an external end, the internal end being operatively coupled with respect to the primary region, the external end operatively coupled with respect to the soap dish, positioned adjacent to the tray, and wherein the soap dish and the tray are circular and wherein the coupling assembly includes a hollow circular ring constituting the attachment mechanism with the internal end pivotally attached to the tray through a first vertical axis positioned in a recess in the tray and with the external end pivotally attached to the soap dish through a second vertical axis positioned in a recess in the soap dish, the first and second vertical axes being at diametrically opposite locations of the ring;

the coupling assembly adapted to allow the movement of the soap dish with respect to the tray between an inoperative orientation and an operative orientation and through an intermediate orientation, the inoperative orientation being at a location with the soap dish above the tray whereby moisture from the soap in the tray will fall through the apertures of the soap dish into the tray, the operative orientation being at a location with the soap dish above the secondary area whereby moisture, from the soap dish will fall through the apertures of the soap dish and be drained away.

* * * * *